US007670221B2

(12) United States Patent
Davis et al.

(10) Patent No.: US 7,670,221 B2
(45) Date of Patent: Mar. 2, 2010

(54) METHOD OF PLAYING A POKER-TYPE GAME

(75) Inventors: Patrick Davis, Kamloops (CA); Greg Paolini, Vancouver (CA)

(73) Assignee: British Columbia Lottery Corporation, Kamloops, British Columbia (CA)

( * ) Notice: Subject to any disclaimer, the term of this patent is extended or adjusted under 35 U.S.C. 154(b) by 164 days.

(21) Appl. No.: 11/804,214

(22) Filed: May 17, 2007

(65) Prior Publication Data

US 2008/0007003 A1 Jan. 10, 2008

(30) Foreign Application Priority Data

May 19, 2006 (CA) ..... 2547431

(51) Int. Cl.
*A63F 13/00* (2006.01)

(52) U.S. Cl. ..... 463/11; 273/292; 463/13

(58) Field of Classification Search ..... 273/292; 463/11, 13

See application file for complete search history.

(56) References Cited

U.S. PATENT DOCUMENTS

| | | | | |
|---|---|---|---|---|
| 2,053,812 | A | 9/1936 | Bradshaw | |
| 2,227,649 | A | 1/1941 | Hutchinson | |
| 2,415,607 | A | 2/1947 | Sacchini | |
| 2,427,076 | A | 9/1947 | Tabacchi | |
| 5,489,101 | A | 2/1996 | Moody | |
| 5,718,430 | A | 2/1998 | Aramapakul et al. | |
| 6,042,118 | A | 3/2000 | Poitra | |
| 6,102,402 | A | 8/2000 | Scott et al. | |
| 6,132,311 | A | 10/2000 | Williams | |
| 6,386,973 | B1 | 5/2002 | Yoseloff | |
| 6,517,072 | B1 | 2/2003 | McInerney | |
| 6,637,747 | B1 | 10/2003 | Garrod | |
| 6,651,983 | B1 | 11/2003 | Chobanian | |
| 7,334,795 | B2 * | 2/2008 | Wonpu | 273/274 |
| 7,387,571 | B2 * | 6/2008 | Walker et al. | 463/26 |
| 2002/0008356 | A1 * | 1/2002 | De Keller | 273/292 |
| 2003/0064767 | A1 | 4/2003 | Brown | |
| 2003/0130023 | A1 * | 7/2003 | Angel | 463/13 |
| 2004/0092312 | A1 * | 5/2004 | Toyoda | 463/42 |
| 2005/0107148 | A1 | 5/2005 | Webb | |
| 2006/0084506 | A1 * | 4/2006 | Yoseloff et al. | 463/42 |
| 2006/0111167 | A1 * | 5/2006 | Breslo | 463/13 |
| 2007/0105608 | A1 * | 5/2007 | Dransfield | 463/13 |
| 2007/0149267 | A1 * | 6/2007 | Ross et al. | 463/13 |
| 2008/0045287 | A1 * | 2/2008 | Amirsadri et al. | 463/13 |

FOREIGN PATENT DOCUMENTS

| | | | |
|---|---|---|---|
| CA | 2053812 | C | 5/1992 |
| CA | 2227649 | A1 | 8/1998 |
| CA | 2427076 | A1 | 3/2002 |
| CA | 2415607 | A1 | 7/2003 |

* cited by examiner

*Primary Examiner*—Gene Kim
*Assistant Examiner*—Matthew B Stanczak
(74) *Attorney, Agent, or Firm*—The Webb Law Firm

(57) ABSTRACT

There is provided a method of playing a poker-type game amongst a large number of players located at remote locations. The method includes the steps of dividing a standard 52-card deck into a reserve and a player deck, so that the reserve contains 16 randomly selected cards and the player deck contains the remaining 36 cards. Each player is then provided with a ticket showing two randomly selected cards from the player deck. Fictitious opponents are each provided with two randomly selected cards from the reserve, while five randomly selected cards from the reserve are used to form the community cards. As in Texas Hold'Em poker, the best 5-card poker hand for each player and each fictitious opponent is determined from amongst the two cards the 5 community cards. Two categories of prizes are awarded. The first two players whose hands beat all fictitious opponents. If no player beats all fictitious opponents, then the second prize goes to the players with the best hands amongst all players participating in the game. Optionally, there may also be a "Bad Beat Jackpot" for certain exceptionally good hands that do not beat all fictitious opponents. There is also provided an apparatus for carrying out this method.

12 Claims, No Drawings

METHOD OF PLAYING A POKER-TYPE GAME

FIELD OF THE INVENTION

The present invention relates to a method of playing a poker-type game amongst a large number of players located at remote locations. The game allows players to play against fictitious opponents and to place wagers based on the strength of the player's initial two cards.

BACKGROUND OF THE INVENTION

With the tremendous increase in popularity of poker-type games, it is not surprising that there are a vast number of patents and patent applications directed to various aspects or versions of the game. There are many patents and patent applications in the United States and Canada that involve playing poker in some way. The following is a brief review of some of them.

U.S. Pat. No. 5,489,101 discloses a style of poker that incorporates elements of Texas Hold'Em and 5 card draw poker. Each player is dealt 5 cards, and the players may discard any or all or none of the cards. Six community cards are dealt face down (until all players have discarded if they want to) in a triangle pattern with 3 in one row, 2 in another, and 1 in another. Players use specific ones of these community cards to complete their hand if they discarded any of their initial cards. If they discarded one, they use the point in the triangle (the one card row); if they discarded two they use the middle row of the triangle that has two cards; if they discarded three they use the top row of three cards; if they discarded 4, they use the 3 card row and the one card row; if they discarded all, they use the top two rows (3 and 2 card rows). Players win based on a prize board ranking of hands.

U.S. Pat. No. 5,718,430 describes a "California Express Hold'em" game that is a modified Texas Hold'Em game where each player is dealt 3 personal cards and must discard one of them, thus keeping 2 cards. Then 5 community cards are revealed, and the players make the best possible 5-card hand out of the 7 cards they have. The objective of this game is to increase speed and decrease complexity, particularly by eliminating successive rounds of betting. The game allows the players to place wagers before they see their personal cards, but there is no further betting. This game is principally directed to casino play where a relatively small group of players play against each other.

In U.S. Pat. No. 6,042,118, the game involves each player getting 2 random cards and trying to build a 5-card poker hand with their 2 cards and only 3 community cards. Additionally, in this game, after the players are shown 2 of the 3 community cards, they can double their initial bet if they choose. Players that achieve a specific 5-card hand that ranks on the prize board win the associated prize.

U.S. Pat. No. 6,102,402 is for "Bad Beat Stud", and is based on 7-card stud poker. Players start by paying an ante amount. Players and the dealer then receive 5 personal cards face down. After seeing their starting cards, the players must make an additional wager to continue playing. Two community cards are then dealt, and the players must make a further (third) wager to remain in the game. Players who have made the required three wagers win if they have a minimum qualifying hand (i.e. a pair) and their hand beats that of the dealer. There is also an option for a player to make an additional 'side bet' to be eligible for a special payout. This side bet may involve a 'bad beat' component where the player has a strong hand, but loses to the dealer.

U.S. Pat. No. 6,132,311 is for a video poker game that combines elements of Texas Hold'Em and 5 Card Draw Poker where the player (who plays on his own) can play up to five hands at once. Two community cards are dealt face up. The player gets 2 random cards which they can use with up to 5 sets of 3 unknown cards to make a poker hand. After seeing the 2 community cards, the player has the option to replace one or both of them. At this stage, the player can then double their wager or keep it the same. Once this is completed, the sets of 3 unknown cards are revealed and the player gets a payout if they achieve a 5-card hand that ranks on the prize board. Thus, in this game, it is possible for the player to increase the wager after seeing two cards, payouts are based on a pay table, cards can be discarded and replaced, and it is directed to a video format for single players only.

U.S. Pat. No. 6,386,973 is a patent for a draw-poker based game where the player has the option to discard and replace one or more cards from the starting hand. The game is designed for live casino poker, but it has one video element that displays a random card from a 2nd deck of cards, which is used to determine the rank and value of wild cards. This game is also transferable to pure video draw-poker. The payouts are based on a prize board with various hands assigned specific payouts.

U.S. Pat. No. 6,517,072 discloses a poker card game where each player antes and receives 4 cards face down. The dealer also gets 4 cards face down. Players can fold, or must match the amount of all the antes from players and dealer to stay in. Players staying in then share 3 community cards to use to complete their 5-card poker hand, with the highest hand at the table winning the pot.

U.S. Pat. No. 6,637,747 is for a variation on Texas Hold'em but played against a dealer instead of other players. A unique feature in this game is that one of the dealer's cards is set in advance, and displayed to all players ahead of time. Players start by providing an ante bet, and receive a 2-card hand. Players can then fold or continue to play. The game then plays like traditional Texas Hold'em, with three community cards being displayed, then a fourth, and then a fifth, with optional chances to increase their wagers, remain the same, or fold. A further option in this game is to place a side bet at the beginning to compete against a prize board instead of the dealer. In another embodiment, neither of the dealer cards is displayed, while betting and overall play remains the same as in the preferred embodiment.

U.S. Pat. No. 6,651,983 discloses a poker game very similar to traditional Texas Hold'em but with minor differences. Instead of players getting two personal, hidden cards and using up to 5 shared community cards to make the best 5 card poker hand, the players get three hidden cards and use up to 4 shared community cards. Multiple rounds of betting occur as the community cards are revealed (as in Texas Hold'em).

US Patent Published Application No. 2003/0064767 A1 is principally directed to eliminating cheating in poker games. A computer replaces the dealer, and there is no deck of cards. The community cards are displayed on a video screen and the players' cards are printed on a printer at the player's station. The game proceeds as an ordinary poker game. The players compete directly against each other and have the ability to make decisions and communicate them to the central computer during the game.

US Patent Published Application No. 2005/0107148 A1 describes a variant of Texas Hold'em Poker that is designed to reduce the house advantage, with the hope of attracting more players to the table. The primary aspect of the game involves the players making four wagers. The first three "competition wagers" are placed against the other players, and resolved when different cards are dealt. There is no house advantage in this aspect. The fourth "proposition wager" is determined against a fixed payout scale. The house has an advantage on the proposition wagers. In a second embodiment, players make a single competition and single proposition wager. The former is against the other players; the latter against the house. The payout for the competition wager is 1:1.

Canadian Patent No. 2,053,812 discloses a typical video poker game, with the added feature that the player can increase their wager after seeing their starting hand, even though they may already be a winner. The player starts by placing a wager, and then sees their starting hand. At this point, the starting hand is an incomplete hand as there is at least one more card to come to complete the hand (the incomplete starting hand might already have a pair of matching cards or better and thus, already a winning hand). At this point the player can make another wager (or not) before receiving the rest of their cards. Winners are paid out according to a hand-ranking table.

Canadian Patent Application 2,227,649 is for a modified draw poker game (as opposed to stud Texas Hold'em) where a player may discard cards and attempt to improve his hand. The player is dealt 5 cards and after dealing, the player has the option to fold or place a second bet. Players may then discard cards and draw replacements. Players compete against a player bank (preferably the dealer) for both high and low value hands. Also disclosed is a progressive jackpot where players pay an optional bet before receiving any cards for a chance at winning the progressive jackpot, which is paid out if a player achieves a specific predetermined hand or better. As well, there is disclosed a high-low poker game where each player must declare his hand as high, low, or high-low.

Canadian Patent Application 2,415,607 describes an improvement to known casino games such as Blackjack and Baccarat. An objective is to inject the excitement and player interaction seen in Poker into these kinds of games. This published application contemplates two mandatory wagers: a "first wager" and a "pot wager". Using Blackjack as the example, the player's first wager applies to an ordinary Blackjack game. The second wager is put into a pot. The players compete against the house for the first wager according to the usual rules of Blackjack. The players then compete against each other for the pot—the player who has the best hand takes the pot. In the event of a tie, the pot can be shared among the winners or carried over to the next hand. "Bad Beat" jackpots are also contemplated, but are paid on certain combinations of cards, and are not contingent on cards held by other players or the dealer.

Canadian Patent Application No. 2,427,076 is for a gaming station for playing a house banked card game between a plurality of players and the house, the game having multiple win possibilities from multiple bet opportunities. The primary aspect of the game has players competing against other live players for the best poker hand. The secondary aspect of this game allows players to win if the hand they achieve is of a predetermined rank, which is automatically paid according to an associated payout table ranking for that hand. Also, this game has a 'bad beat' feature which pays a losing player that achieves a predetermined high-ranking hand.

There remains a need to provide a poker-type game that can be played amongst a large group of players located at remote locations.

The disclosures of all patents/applications referenced herein are incorporated herein by reference.

SUMMARY OF THE INVENTION

The present invention is directed to a monitor version of Texas Hold'em poker in which large numbers of players may participate at the same time in one game. In the preferred embodiment of the present invention, the players, who may be located at remote locations, will each purchase a ticket at an initial purchase price for use in a game to be held at a fixed future time. The initial purchase price is considered an initial bet. The tickets will show two cards. After purchasing the ticket, but before playing the game, the player may increase his initial bet by purchasing further pre-determined increments of the initial purchase price, with each such further increment considered another bet. Each purchased bet provides the player with a "share", which will have an impact on the size of the prize that may be ultimately won by the player.

Games are scheduled for pre-set times, and all players who have purchased tickets for a particular game participate in the same game at the same time. Players may follow the game by way of display devices, such as monitors, located at numerous remote locations. This is unlike the typical video poker games often seen in casinos where individuals play only against the computer, and at their own pace.

The 2-card combinations shown on the tickets are created as follows: from a standard 52-card deck, 16 cards are removed and are kept together as "the Reserve". The remaining 36 cards are referred to as "the Deck". The 36 cards in the Deck are used to create the two-card combinations that appear on the tickets sold to the players. With 36 cards in the Deck, there are a total of 630 possible two-card combinations that may be made from the Deck. If, in the course of a game, all 630 two-card combinations are sold, the same two-card combinations will then be sold again.

When the game is set to begin, players can no longer purchase tickets for that game. At the time that the game is played, the Reserve cards (16 cards) are used to create two-card hands for fictitious opponents, preferably four fictitious opponents. All players who have purchased tickets for that game will "play" against these fictitious opponents. Five of the remaining eight Reserve cards are called the "Community" cards (the flop, turn and river cards in ordinary Texas Hold'em). The hands of the fictitious opponents and the five Community cards will be the same for all players in each particular game. Unlike ordinary Texas Hold'Em, the player does not have the opportunity to raise, stand or fold as the Community cards are dealt. The remaining three cards in the Reserve are the "Burn" cards, which are set aside and not shown to any player.

Once the five Community cards are revealed, the best 5-card poker hand is determined for all players and for the fictitious opponents (the same as in ordinary Texas Hold'Em poker). Winners of the game are then determined as follows. If at least one player participating in the game has a 5-card poker hand that is better than the 5-card poker hand of all fictitious opponents, then "Prize A" is awarded. Prize A is a "pot" that consists of a pre-determined percentage of all amounts wagered by all players for that game. Therefore, this is a pari-mutual betting arrangement. All players in the game who have beaten all fictitious opponents will divide the Prize A pot according to each player's share(s).

In circumstances where none of the players participating in the game has a 5-card poker hand that beats the 5-card hands of all fictitious opponents, "Prize B" will be awarded. The winner of Prize B is determined by comparing the 5-card poker hands of all players in the game to each other (and not to the fictitious opponents). The player or players with the highest-ranking 5-card poker hand will win the pot according to their respective share(s). Again, this is a pari-mutual betting arrangement where the pot consists of a pre-determined percentage of all amounts wagered by all players for that game.

There is also a "Prize C" that may be offered, which is referred to as a "Bad Beat Jackpot". This Bad Beat Jackpot will be awarded in rare circumstances, when certain specific conditions are met. In short, the Bad Beat Jackpot is awarded when a player has a very strong hand (that is, a straight flush or four of a kind), but the player does not beat all fictitious opponents. Unlike Prizes A and B, the Bad Beat Jackpot is a progressive jackpot.

Accordingly, one aspect of the present invention provides a method of playing a poker-type game amongst a large number of players, the method comprising the steps of:

a. dividing a standard 52-card deck into a reserve and a player deck, wherein the reserve contains 16 randomly selected cards and the player deck contains the remaining 36 cards,
b. providing each player with a ticket showing two randomly selected cards from the player deck,
c. creating fictitious opponents who are each provided with two randomly selected cards from the reserve,
d. exposing five randomly selected cards from the reserve to form the community cards,
e. determining the best 5-card hand for each player amongst the two cards on the player's ticket and the 5 community cards,
f. determining the best 5-card poker hand for each fictitious opponent amongst the opponent's two cards and the 5 community cards,
g. comparing each player's best 5-card poker hand with the best 5-card poker hand of each fictitious opponent to determine which of the players has a best 5-card poker hand that beats the best 5-card poker hand of all fictitious opponents, and
h. declaring each player that beats all fictitious opponents as a first prize winner.

According to a further aspect of the present invention, there is provided an apparatus allowing a large number of players to play a poker-type game, comprising:

a. a central computer system,
b. a plurality of remotely located terminals,
c. a plurality of remotely located display devices, and
d. means for causing data to be communicated between the central computer system, the terminals and the display devices, wherein the central computer system comprises means for:

i. dividing a standard 52-card deck into a reserve and a player deck, wherein the reserve contains 16 randomly selected cards and the player deck contains the remaining 36 cards,
ii. generating for each player a ticket showing two randomly selected cards from the player deck,
iii. creating fictitious opponents who are each provided with two randomly selected cards from the reserve,
iv. using five randomly selected cards from the reserve to form the community cards,
v. determining the best 5-card hand for each player amongst the two cards on the player's ticket and the 5 community cards,
vi. determining the best 5-card poker hand for each fictitious opponent amongst the opponent's two cards and the 5 community cards,
vii. comparing each player's best 5-card poker hand with the best 5-card poker hand of each fictitious opponent to determine which of the players has a best 5-card poker hand that beats the best 5-card poker hand of all fictitious opponents, and
viii. declaring each player that beats all fictitious opponents as a first prize winner.

Numerous other objectives, advantages and features of the present invention will also become apparent to the person skilled in the art upon reading the detailed description of the preferred embodiments and the claims.

DETAILED DESCRIPTION OF THE PREFERRED EMBODIMENTS

The preferred embodiments of the present invention will now be described.

Game Set Up

The present invention is directed to a modified version of Texas Hold'em poker intended for a gaming environment in which a large number of players may participate in a game.

In the preferred embodiment of the present invention, each player purchases one or more tickets for use in a game to be held at a fixed future time. The price to purchase one ticket is initially set at a pre-determined price, such as $2.00, but it will understand it can be set at any desired price. This initial purchase price of the ticket is considered an initial bet made by the player.

Each ticket purchased by a player will show two cards from a standard deck of playing cards. These two cards are referred to as the player's "Pocket" cards. The two-card combinations that are shown on each ticket available for purchase for each game are created as follows. From a standard 52-card deck, 16 cards are removed and are kept together as the Reserve. The remaining 36 cards form the Deck and these 36 cards are used to create the two-card combinations that are sold to players. Every possible combination of two cards from the 36 Deck cards is available for purchase as a player's Pocket cards. With 36 cards in the Deck, there are a total of 630 possible two-card combinations that may be made. If, in the course of a game, 630 tickets are sold (so that all 630 possible two-card combinations are sold), the same two-card combinations will then be sold again.

Prior to selling tickets to players for a particular game, all 630 possible two-card combinations are scrambled and then sold one at a time until the entire 630 possible two-card combinations are sold. If sales exceed 630 tickets in the same game, that is, more than 630 tickets are sold for one game, the same 630 possible two-card combinations will be sold again. Therefore, at any given time, all 630 possible two-card combinations will be sold the same number of times as any other combination, plus or minus one.

After purchasing a ticket, but before playing the game, the player may increase his initial bet by purchasing further pre-determined increments of the initial purchase price, with each such further increment considered another bet. Each purchased bet, including the initial purchase of the ticket, provides the player with a "share", which will have an impact on the size of the prize that may ultimately be won by the player. Thus, in the preferred embodiment of the present invention, after seeing the two Pocket cards on the tickets, and any time prior to the game beginning, the players may choose to increase their bet from the initial purchase price by increments to a pre-determined maximum. For example, in cases where the initial purchase price is $2.00, players may have the option of increasing their bets by further $2.00 increments to a maximum of $10.00, or perhaps to a maximum of $20.00. Basically, this allows the player to purchase additional shares, so that the player can play with one or more shares for any given ticket, up to a maximum allowed number of shares per ticket. Of course, it will be understood that the specific values of the initial purchase price, available increments and the pre-determined maximum may be altered without departing from the scope of the present invention.

Each player who wishes to participate in a game must purchase a ticket for the initial pre-determined purchase price before the player will be allowed to see that ticket's two-card combination. As well, players will not be allowed to cancel purchased tickets.

After purchasing a ticket and considering the two-card Pocket, a player can decide to keep his ticket as is, that is, keep only one share, or the player may increase the ticket value by purchasing further shares up to the maximum allowable number of shares. In essence, a player is allowed to place further bets on a ticket, which provides the player with more shares, but only until the game begins. No further tickets or shares may be purchased after the game begins.

Preferably, the present invention is implemented over a network comprising a central computer system and a plurality of terminals and display devices, which may preferably be located remotely from the central computer. The network will include means for causing data to be communicated between the central computer system, the terminals and the display devices, such as a wide area network, the internet, wireless communications, etc. Thus, players may be located at remote locations and still be able to play the game. In a preferred embodiment, the present invention will be implemented within the hospitality and restaurant industries. For example, players may purchase tickets from a computer terminal (for example, an ALTURA terminal) or self-service terminal ("SST") located in a restaurant/bar. The terminal will provide the player with a ticket that shows the players' two-card Pocket combination, which was randomly generated by the central computer system. This ticket is valid for a specific game that will begin at some pre-determined point in the future. At any time prior to the game beginning, players may increase their bets or shares based on the perceived strength of their Pocket. Once the game begins, players may watch on a monitor located in the establishment where the ticket was purchased to see the game unfold as described below and determine whether or not they have won, based on the strength of their best 5-card poker hand.

Therefore, players will have the ability to raise their bet at anytime prior to the actual game by purchasing additional shares as described herein.

The terminals where tickets can be purchased may also allow players to purchase tickets for a series of upcoming games rather than just one upcoming game. In a most preferred embodiment, a player may purchase tickets for upcoming games (for example, up to 5 or 10 upcoming games), including placing additional bets (that is, purchasing additional shares) on each of these upcoming games purchased. Each ticket purchased by a player will be printed separately (1 ticket per hand per game), in order to facilitate the players' ability to place additional bets on a game.

In the implementation of the preferred embodiment of the present invention where multiple games will be played throughout a day, the following sequence of events will occur using the central computer system. Every morning, draws will take place in advance of the first game of the day to determine which cards for each of that day's games will be placed in the Reserve (16 cards), which cards are randomly assigned as the Burn cards (3 cards), which cards will be the two cards for each of the fictitious opponents (8 cards in all), and which will be the community cards (5 cards). For example, if 50 games are scheduled to be played in a day, this procedure will occur every morning for each of the 50 games that will be played that day. A file containing this data will be created and maintained in case it is required later for audit purposes or potentially for consumer inquiry.

A ticket will be printed at a terminal for each game that a player wishes to play in. The ticket may preferably include the name of the lottery game being played, for example, "Pacific Hold'em Poker", the date the ticket was purchased, the draw (game) number, the 2-card combination (Pocket) drawn for the given game, the initial wager placed by the player (adjusted for any applicable additional bets placed), a retailer ID number or other indicia used to identify where the ticket was purchased, a bar code and an internal control number.

Games are scheduled for pre-set times during the day, and all players who have purchased tickets for a particular game participate in the same game at the same time. There is, therefore, no limit on the number of players that may participate in each game. Players may watch the game unfold on display devices, such as monitors, preferably video monitors, located at numerous remote locations such as bars and restaurants.

Playing the Game

When a game is set to begin, players can no longer purchase tickets for that game. Therefore, after all players have purchased tickets for the game and, if desired, raised their bets and purchased additional shares, the 16 Reserve cards are used to generate the Community cards and the 2-card combinations for each of the fictitious opponents. While the 16 Reserve cards are determined prior to the game as described above, the position of each Reserve card is not determined until after the game begins. At this time, another draw determines the order in which the 16 Reserve cards are used to make up the three Burn cards, which are never seen, the five Community cards and the four 2-card combinations for the fictitious opponents. Even though the Burn cards are never seen, they are still part of the draw, as they have been eliminated from the Deck cards used to generate the 630 2-card combinations forming the Pockets.

When the game begins, the 16 Reserve cards are used to create two-card hands for the fictitious opponents. All players who have purchased tickets for that game will "play" against these fictitious opponents. Five of the remaining eight Reserve cards form the Community cards (the flop, turn and river cards in ordinary Texas Hold'em poker). The hands of the fictitious opponents and the five Community cards will be the same for all players who participate in each particular game. Unlike ordinary Texas Hold'Em, once the game begins, a player does not have the opportunity to raise, stand or fold as the Community cards are dealt.

In a preferred embodiment, when the game begins, the five Community cards are revealed on the monitor. These five Community cards, together with a player's two Pocket cards form the seven available cards from which the best possible 5-card poker hand is determined. Also at this time, the monitor will reveal the 2-card combinations for each of the fictitious opponents. When the five Community cards and the hands of the fictitious opponents are shown, the computer system calculates the best possible 5-card poker hand for each player and for each of the fictitious opponents. Only the best possible 5-card poker hand for each player and fictitious opponent is used to determine which player wins and what prize is allocated to the winning players as described below.

The three Burn cards in each game will be shown to be dealt facedown on the video monitor screen. The three Burn cards will represent the cards that in traditional Texas Hold'em are referred to as "burned" (to avoid stacking the deck, etc.).

Most preferably, the sequence for each game played will take approximately two minutes to unfold. This time period does not include the time allocated prior to the game for players to purchase tickets and place additional bets. Once a game begins at its pre-determined time, the following sequence of events will take place and be shown on all the display devices:

a. Title Sequence is shown on the display devices for about 5 seconds.
b. The cards are shown to be shuffled (about 5 seconds).
c. Two cards are shown to be dealt to each of the fictitious opponents (about 10 seconds) and to the "player" spot at the table to begin the game.
d. The fictitious opponents are shown to peak at their two-card combinations (about 5 seconds).
e. The first of the three Burn cards is discarded face down, and the first three cards of the Community are shown (about 5 seconds).
f. A pause of about 3 seconds is provided.
g. The second of the three Burn cards is discarded face down, and the fourth Community card is shown (about 5 seconds).
h. A pause of about 3 seconds is provided.
i. The third of the three Burn cards is discarded face down, and the last of the 5 Community cards is shown (about 5 seconds).
j. A pause of about 3 seconds is provided.
k. The hands of the fictitious opponents are revealed on the display devices (about 15 seconds).
l. A pause of about 3 seconds is provided.
m. The best possible hands from among the fictitious opponents are displayed on the display devices (about 20 seconds).

Prizes

At the conclusion of a game, winners of that game are determined as follows. In the preferred embodiment of the present invention, there are two possible ways to win a game. "Prize A" is awarded if there is at least one player who holds a 5-card poker hand that is better than each of the 5-card poker hands held by all fictitious opponents. All such players are winners of Prize A and will share in the pot. If there are no players that have a 5-card poker hand that is better than the 5-card hands of all fictitious opponents, then "Prize B" is awarded to all players who hold the best 5-card poker hand from among all player hands. All Prize B winners will similarly share in the pot.

In addition to these two possible ways to win a game, there may also be a third category of prize: a "Bad Beat Jackpot". This Bad Beat Jackpot can be won by a player who has an exceptionally strong hand but is still unable to beat all fictitious opponents.

Prize A is the typical prize that will be awarded after a game—it is expected to be won in over 95% of all games, assuming that there are at least 630 players participating in each game. However, when there are no Prize A winners, then Prize B is awarded. Each of Prize A and Prize B are funded in a pari-mutual manner using a predetermined percentage of all money wagered by the players in that game, with all prize amounts rounded to the nearest $1. For example, it may be determined that 60% of all monies wagered by players in a game will be placed in the "pot", and all winners of Prize A or Prize B will share in the pot depending on the number of shares owned by each player. Another pre-determined, smaller percentage of money wagered by the players is allocated to the Bad Beat Jackpot. The Bad Beat Jackpot is expected to be won very rarely (in less than 1% of draws) because a number of specific conditions must first be met, as described below.

Prize A is awarded if at least one player participating in the game has a 5-card poker hand that is better than each of the 5-card poker hand of all fictitious opponents. All players in the game who have beaten all fictitious opponents will divide the Prize A pot according to each player's share(s). Note that when a player has the same hand as one of the fictitious opponents, this is considered a "tie". In normal Texas Hold'em, a "tie" is called a Push, and both players take one-half of the pot. In the preferred embodiment of the present invention, however, ties do not win anything.

Each player that has won Prize A in a given game wins an amount that is calculated by dividing the total pot available in that game by the total number of winning shares and rounding to the nearest $1. In other words, each player that has a Prize A winning ticket receives one winning share for each pre-determined amount wagered on the ticket (preferably, there is a maximum of five shares on each ticket).

In a most preferred embodiment, a player pays $2.00 for the initial price of a ticket, and may wager additional $2.00 increments to a maximum of $10.00. Thus, each player will own from 1 to 5 shares, depending on the total amount wagered on that ticket. The total pot available to Prize A winners is calculated as being 60.0% of all monies wagered in that game by all players. The total pot is then split evenly between all players who won Prize A among the total number of prize shares from the winning players.

In the circumstance where none of the players participating in the game has a 5-card poker hand that beats the 5-card hands of the fictitious opponents (that is, there are no Prize A winners in the game), then Prize B will be awarded. The winner(s) of Prize B is determined by comparing the best 5-card poker hands of all players participating in the game to each other (and not to the fictitious opponents). The player or players with the highest-ranking 5-card poker hand are winners of Prize B and will share the pot according to their respective share(s). Again, this is a pari-mutual betting arrangement where the pot consists of a pre-determined percentage (preferably 60%) of all amounts wagered by all players for that game.

It is estimated that in about 4% of all games where 630 tickets are sold, the best 5-card hands of the fictitious opponents are so strong that it is impossible for any of the 630 available Pockets to win. If not all of the 630 available Pockets are sold in a game, the frequency could be higher than 4%. Where Prize B is awarded, all player hands in that game are examined and ranked regardless of their ability to beat the fictitious opponents. All player hands that match the highest 5-card player hand are awarded Prize B with the total pot split evenly between all players who won Prize B among the total number of prize shares from the winning players.

As can be appreciated, in each game played there will be either a Prize A winner or a Prize B winner, thus, the pot is always awarded after each game.

In addition to Prizes A and B, a third category of prize may also be available. This is the Bad Beat Jackpot. This Bad Beat Jackpot will be awarded in rare circumstances, when certain specific conditions are met. In short, the Bad Beat Jackpot is awarded when a player has a very strong 5-card hand in a game (for example, a straight flush or four of a kind), but the player does not beat the 5-card hands of all fictitious opponents. Unlike Prizes A and B, which are pari-mutual arrangements, the Bad Beat Jackpot is a progressive jackpot.

The Bad Beat Jackpot may be awarded regardless of the outcome of the Prize A or Prize B. In a most preferred embodiment of the present invention, the Bad Beat Jackpot will consist of 1% of all monies wagered by players. The jackpot is cumulative so that it increases from game to game until the Bad Beat Jackpot is eventually won.

In this most preferred embodiment, the Bad Beat Jackpot is won by a player who achieves a certain set of conditions, such as the following:

a. The player's best 5-card poker hand is either a straight flush or a four-of-a-kind;
b. The player's best 5-card poker hand does not beat the best 5-card poker hand of all fictitious opponents, that is, the player does not win a share of Prize A (although the player could win a share of Prize B);
c. Since a tie is not a win, the player's best 5-card poker hand could be a tie with the best 5-card poker hand of one of the fictitious opponents and still qualify for the Bad Beat Jackpot;
d. The player's best 5-card poker hand is the best hand that can be made from the player's Pocket and all five Community cards;
e. The player's best 5-card poker hand is better than the 5-card poker hand formed from just the five Community cards. In other words, at least one of the player's Pocket cards must be used and the resulting hand must be stronger than the hand formed from the 5 Community cards. For example, if the Community cards are four-of-a-kind in Kings with a Queen high, the player's Pocket must contain an Ace and one of the fictitious opponent's cards must also be an Ace. If instead, the player's Pocket holds a Queen, the player's hand is equivalent to the Community hand and does not qualify for the Bad Beat Jackpot;
f. At least one of the two cards of a fictitious opponent must be used for the fictitious opponent's best 5-card poker hand;
g. The player's best 5-card poker hand is the strongest hand from amongst the best 5-card poker hands of all other players in the game. For example, one of the fictitious opponents has four-of-a-kind in Tens with a King high. If some players also have four-of-a-kind in Tens with a King high, and other players have four-of-a-kind in Tens with a Queen high, only the Players with the higher hand (King High) share in the Bad Beat Jackpot. A player with four-of-a-kind with Ace high would win a share of the Prize A pot since that hand beats the best hands of all fictitious opponents;
h. If the best 5-card poker hands of more than one player meets all of the Bad Beat Jackpot conditions, then the Bad Beat Jackpot will be shared amongst these players; and
i. Shares of the Bad Beat Jackpot will be awarded per share as is the case with the Prize A and Prize B pots.

As noted above, the Prize A and Prize B prize structure is purely pari-mutuel, so the size of these two prizes will vary depending on the number of players participating in any given game, and the number of shares held by the winners in that game. The Bad Beat Jackpot, on the other hand, is not pari-mutual, but instead is a progressive or cumulative jackpot. In a most preferred embodiment, the cumulative jackpot may initially be set as $500.00 or the accumulation of 1% of all sales receipt (initial ticket purchase plus all additional wagers) until there is a winner of the Bad Beat Jackpot, whichever amount is greater.

Game Display

The progress of the game will be displayed at remote locations via display devices such as monitors. The details of the game itself will be transmitted from the central computer system to the various display devices via means for permitting this data to be communicated between the central computer system and the display devices. Preferably, the following information will be displayed on each of the display devices for each game played:

a. Advertising, rules, and pre-game information may be shown in between games, as well as the amount of the Bad Beat Jackpot and what hands are needed to qualify for it.
b. Just prior to the game beginning, the game will be "announced" on the display devices.
c. Two cards are then shown to be dealt (face-down) to each of the four fictitious opponents around the table and to the "player" spot at the table to begin the game.
d. The first three community cards ("flop") are then revealed in the center of the table (face-up).
e. The players on the display devices may be shown to glance at their cards.
f. The "turn" and "river" cards (the two remaining community cards) are then revealed (face-up).
g. A "burn card" is shown to be dealt facedown before each of the flop, turn and river (three burn cards in total).
h. Following revealing the flop, turn and river, each of the fictitious opponent's hands around the table are revealed.
i. The fictitious opponent "hand to beat" is identified and highlighted on the display devices. This is the best hand from amongst the hands of the fictitious opponents.
j. After a short pause, the display devices may then announce how many players are winners of Prize A, and how much money each share wins.
k. In the event there is no Prize A winner, the display devices would display the best hand from amongst all the players in the game, which would then win Prize B. Also displayed would be how much money each share wins.
l. In the event of a winner of the Bad Beat Jackpot, the display devices would display the Bad Beat Jackpot winning hand and prize amount in the jackpot.
m. The display sequence would then repeat for the next game.
n. Between games, the display devices may show a countdown clock with the time remaining until the next game.
o. The particular game identification number will also be displayed as a reference.

As a further embodiment to the above described game, players may be given the option of placing an additional "side bet" for a fixed amount. The player may place this side bet at the time of purchasing the ticket before the Pocket (two-card combination) is revealed to the player. This side bet would allow the player to play against a set-payout table, that is, the player would win for achieving a specific hand according to the set-payout table, regardless of whether they beat the fictitious opponents or not.

In the present invention, poker hands are ranked according to the well-known rankings used in poker games. Individual cards are ranked from high to low as ace, king, queen, jack, 10, 9, 8, 7, 6, 5, 4, 3, 2. There is no ranking between the suits. The 5-card hands are ranked as follows, from highest to lowest ranking:

1. Royal Flush is the highest poker hand that can be obtained. It consists of ace, king, queen, jack and 10, all in the same suit.

2. Straight Flush is five cards of the same suit in sequence. Between two straight flushes, the one containing the higher top card is higher. In a straight flush, the ace can be counted as low.
3. Four of a kind is where the player has four cards of the same rank. Between two fours of a kind, the one with the higher set of four cards is higher.
4. Full House consists of three cards of one rank and two cards of another rank—for example three sevens and two tens. When comparing full houses, the rank of the three cards determines which is higher.
5. Flush is five cards of the same suit. When comparing two flushes, the highest card determines which is higher. If the highest cards are equal then the second highest card is compared; if those are equal too; then the third highest card, and so on.
6. Straight is five cards of mixed suits in sequence. When comparing two straights, the one with the higher ranking top card is better. An ace can count as high or low.
7. Three of a Kind is the next ranked hand. It consists of three cards of the same rank plus two other cards. When comparing two threes of a kind, the hand in which the three equal cards are of higher rank is better.
8. Two Pairs. A pair is two cards of equal rank. When comparing hands with two pairs, the hand with the highest pair wins, irrespective of the rank of the other cards.
9. Pair is a hand with two cards of equal rank and three other cards which do not match these or each other. When comparing two such hands, the hand with the higher pair is better.
10. High Card occurs when the five cards do not form any of the combinations listed above. When comparing two such hands, the one with the better highest card wins. If the highest cards are equal the second cards are compared; if they are equal too the third cards are compared, and so on.

Although the present invention has been shown and described with respect to its preferred embodiments and in the examples, it will be understood by those skilled in the art that other changes, modifications, additions and omissions may be made without departing from the substance and the scope of the present invention as defined by the attached claims.

What is claimed is:

1. A computer-implemented method of playing a poker-type game, the method comprising the steps of:

a computer system dividing a standard 52-card deck into a reserve and a player deck, wherein the reserve contains 16 randomly selected cards and the player deck contains the remaining 36 cards, the computer system providing each player with a ticket showing two randomly selected cards from the player deck, wherein the two randomly selected cards are selected for each player from the 36 card player deck such that one player may have one or both of the same randomly selected cards as another player, the computer system creating fictitious opponents who are each provided with two randomly selected cards from the reserve, the computer system exposing five randomly selected cards from the reserve to form the community cards, the computer system determining the best 5-card hand for each player amongst the two cards on the player's ticket and the 5 community cards, the computer system determining the best 5-card poker hand for each fictitious opponent amongst the opponent's two cards and the 5 community cards, the computer system comparing each player's best 5-card poker hand with the best 5-card poker hand of each fictitious opponent to determine which of the players has a best 5-card poker hand that beats the best 5-card poker hand of all fictitious opponents, and the computer system declaring each player that beats all fictitious opponents as a first prize winner.

2. The method of claim 1, wherein there are four fictitious opponents.

3. The method of claim 1, wherein each player purchases the ticket for a pre-determined initial price and thereby obtains a potential share of a pot for each ticket purchased.

4. The method of claim 3, further comprising the steps of allowing each player to place a wager by purchasing further increments of the pre-determined initial price of the ticket, and each such further increment purchased provides the player with a further potential share of the pot.

5. The method of claim 4, wherein the purchasing of further increments may take place at anytime after each player is provided with a ticket showing two randomly selected cards but before the fictitious opponents are each provided with two randomly selected cards from the reserve.

6. The method of claim 4, comprising the further steps of creating the pot from all the wagers placed by the players and then dividing the pot amongst the first prize winners according to the shares held by the first prize winners.

7. The method of claim 1, wherein if no player is declared a first prize winner, then each player's best 5-card poker hand is compared with the best 5-card poker hand of all other players, and declaring each player that beats all other players as a second prize winner.

8. The method of claim 7, wherein each player purchases the ticket for a pre-determined initial price and thereby obtains a potential share of a pot for each ticket purchased and further comprising the steps of allowing each player to place a wager by purchasing further increments of the pre-determined initial price of the ticket wherein each such further increment purchased provides the player with a further potential share of the pot and creating the pot from all the wagers placed by the players and then dividing the pot amongst the second prize winners according to potential shares of the pot held by the second prize winners.

9. The method of claim 1, wherein a player who has a best 5-card poker hand comprising a royal flush, a straight flush or 4-of-a-kind, but whose best 5-card poker hand does not beat the best 5-card poker hand of all the fictitious opponent is declared a third prize winner.

10. An apparatus allowing a large number of players to play a poker-type game, comprising:

(a) a central computer system, (b) a plurality of remotely located terminals, (c) a plurality of remotely located display devices, and (d) means for causing data to be communicated between the central computer system, the terminals and the display devices, wherein the central computer system comprises means for:

i) dividing a standard 52-card deck into a reserve and a player deck, wherein the reserve contains 16 randomly selected cards and the player deck contains the remaining 36 cards, ii) generating for each player a ticket showing two randomly selected cards from the player deck, iii) creating fictitious opponents who are each provided with two randomly selected cards from the reserve, iv) using five randomly selected cards from the reserve to form the community cards, v) determining the best 5-card hand for each player amongst the two cards on the player's ticket and the 5 community cards, vi) determining the best 5-card poker hand for each fictitious opponent amongst the opponent's two cards and the 5 community cards, vii) comparing each player's best 5-card poker hand with the best 5-card poker hand of each fictitious opponent to determine which of the players has a best 5-card poker hand that beats the best 5-card poker hand of all fictitious opponents, and viii) declaring each player that beats all fictitious opponents as a first prize winner.

11. The apparatus of claim 10, wherein the plurality of remotely located display devices show the following in this sequence:

(e) two cards are dealt to each of the fictitious opponents;

(f) the first three cards of the community cards are shown;

(g) the fourth community card is shown;

(h) the last of the five community cards is shown;

(i) the hands of the fictitious opponents are shown; and (j) the best possible hands from among the fictitious opponents are shown.

12. The apparatus of claim 11, wherein the tickets are generated at the plurality of remotely located terminals.

* * * * *